US005165877A

United States Patent [19]

Colin

[11] Patent Number: 5,165,877

[45] Date of Patent: Nov. 24, 1992

[54] VACUUM PUMP FOR USE WITH A POOLSIDE SKIMMER

[75] Inventor: George M. Colin, Dana Point, Calif.

[73] Assignee: Jason Development, Inc., Grand Cayman, Cayman Islands

[21] Appl. No.: 690,556

[22] Filed: Apr. 24, 1991

[51] Int. Cl.[5] ..... F04B 21/02

[52] U.S. Cl. ..... 417/551; 417/467; 417/435

[58] Field of Search ..... 417/551, 565, 467, 547, 417/441, 434, 435

[56] References Cited

U.S. PATENT DOCUMENTS 55,022 5/1866 Staples ..... 417/547

1,615,380 1/1927 Hill ..... 417/441

1,999,655 4/1935 Coyle ..... 417/547

2,446,748 8/1948 Etter ..... 417/565

4,808,081 2/1989 Finley ..... 417/199.1

*Primary Examiner*—Richard A. Bertsch

*Assistant Examiner*—Charles G. Freay

*Attorney, Agent, or Firm*—W. Norman Roth

[57] ABSTRACT

A manually operable hand-held unit for eliminating air from a hose to be used as a pool vacuum hose having a quick coupling adaptor for connecting the air-evacuated hose to the inlet of a powered pool skimmer pump to eliminate the necessity of evacuating air from the hose by manually sucking pool water with the mouth.

7 Claims, 1 Drawing Sheet

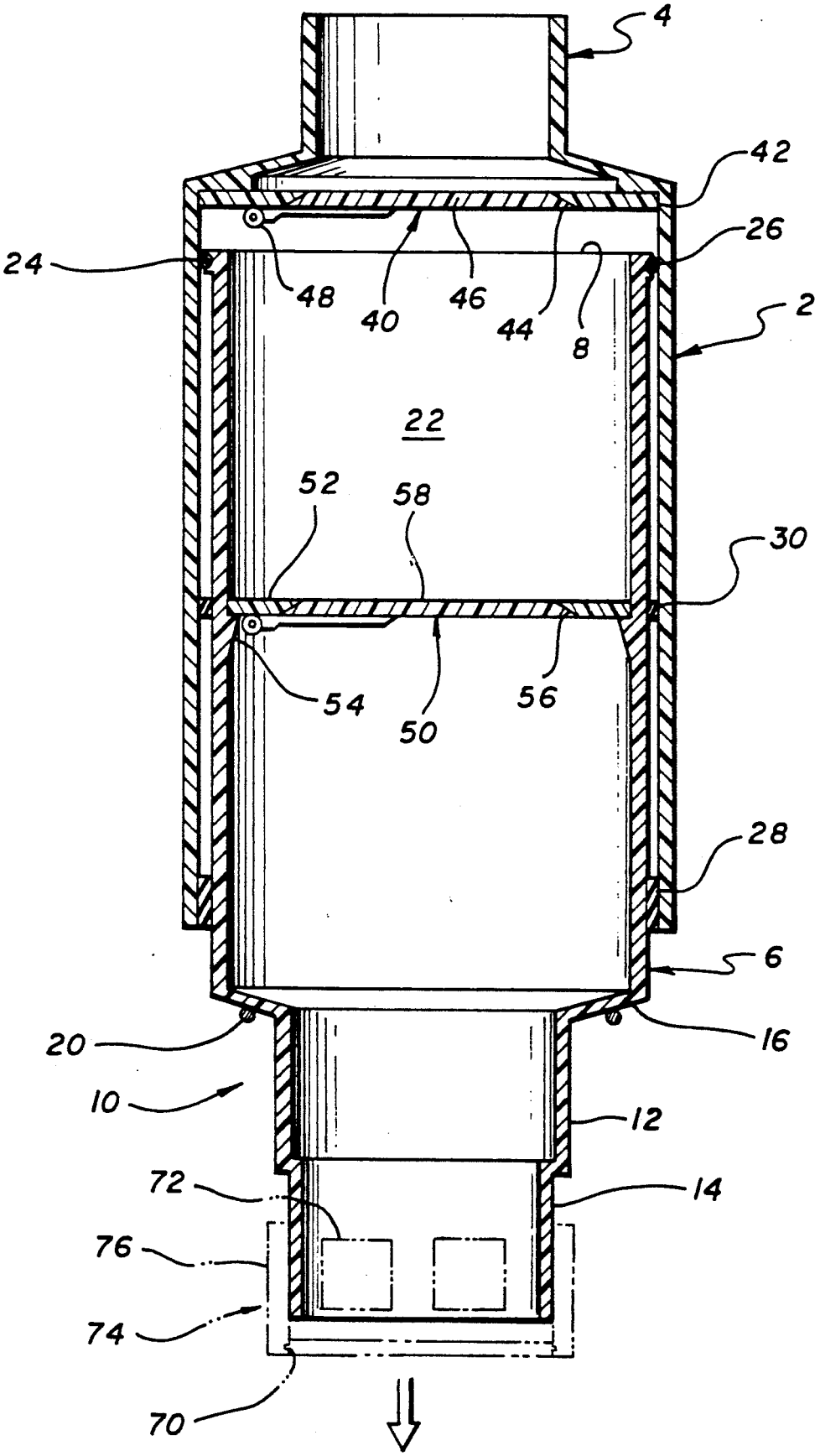
4
42
26
24
48
40
46
44
8
2
22
52
58
30
54
50
56
28
6
20
16
10
12
72
14
76
74
70

VACUUM PUMP FOR USE WITH A POOLSIDE SKIMMER

BACKGROUND OF THE INVENTION AND PRIOR ART

Swimming pool maintenance requires frequent cleaning of debris wich ordinarily rests on the bottom of the pool. To this end pool owners and maintenance personnel will occasionally vacuum the pool using a long corrugated plastic hose (about 30–50' in length) which is carried to the pool and attached to the powered poolside skimmer vacuum inlet to draw water and debris through the hose whereby it may be removed from the pool by the pool filter or traps. Vacuum hoses are typically quite light in weight for easy portability but this has the disadvantage that the hose is filled with air such that a substantial length of the hose floats when it is first deployed in a pool to be cleaned.

In order that the skimmer pump will draw water through the hose it is necessary to first fill the hose with water at least to the extent that most if not all of the air is removed. Failure to do so places an undue load on the skimmer pump while it is merely drawing air from the hose if in fact the pump is able to remove the air from the hose at all.

Pool maintenance personnel typically resort to the difficult and unhealthful process of manually sucking air with their mouths from the free end of the hose after deployment of the hose into the pool with the result that dirty water may drawn into their mouths prior to connecting the free end of the hose to the poolside skimmer inlet.

The prior art is replete with hand-held pumping devices or siphon starters, some of which must be oriented in a particular attitude in order to perform their intended function. One example is shown in U.S. Pat. No. 4,574,828 issued Mar. 11, 1976 to Brumfield in which a pair of concentric tubes are manually reciprocated to operate a pump/siphoning device which must be generally horizontally oriented to siphon liquids.

Other United States patents located in applicant's search include U.S. Pat. No 108,087 issued Oct. 11, 1870 to Averell, et al, and U.S. Pat. No. 1,336,310 issued Apr. 6, 1920 to Marhenke.

It is the primary object of the present invention to provide a lightweight and inexpensive hand held pump and skimmer adaptor unit which is realiably operable regardless of the attitude of the unit and which effectively prevents flow of water through the unit unless the pump is operated and which may be rapidly affixed to the inlet of the powered pool pump thereby effectively eliminating the need for maintenance personnel to suck water into their mouths while filling the vacuum hose prior to connection thereof to the skimmer inlet.

SUMMARY OF THE INVENTION

The present invention accordingly provides a hand-held pump and adaptor unit for connecting a swimming pool vacumm hose to a poolside skimmer pump comprising:

a) a first elongated sleeve having an open end and a hose connector collar extending axially therefrom;

b) a second elongated sleeve telescopicly engaged with said first sleeve, said second sleeve having a skimmer pump inlet adaptor at the end thereof remote from said hose connector collar, said adaptor having at least one fluid outlet;

c) sealing means disposed between an outer peripheral wall of one of said sleeves and an inner peripheral wall of the other of said sleeves, said sealing means permitting said sleeves to telescopicly move thereby providing a variable volume pumping chamber;

d) a first one-way valve permitting fluid flow from said open end into said pumping chamber and preventing reverse flow from said pumping chamber to said open end; and e) a second one way valve in said pumping chamber permitting fluid flow from said pumping chamber to said adaptor outlet and preventing fluid flow from said adaptor outlet into said pumping chamber.

BRIEF DESCRIPTION OF THE DRAWING

The single drawing figure is a vertical sectional view of the unit of the present invention.

DESCRIPTION OF THE PREFERRED EMBODIMENT

The hand-held pump/adaptor unit is seen from the drawing to constitute an axially aligned unit comprised of an outer, preferably cylindrical elongated housing 2 having a cylindrical inlet collar 4 which is attachable to the usual type of corrugated plastic pool vacuum hose. Telescopicly received in the outer housing 2 is a second preferably cylindrical inner housing 6 having an open upper (as seen in FIG. 1) end 8 and a lower end 10 of stepped reduced diameter, the steps 12, 14 of which are configured to be received in the appropriately sized cylindrical inlet openings of different types of powered pool pumps. An abutment shoulder 16 is integrally formed with and interconnects the side wall of the inner housing 6 and the reduced diameter lower adaptor end 10. When the adaptor end 10 is connected to the inlet of a powered pool pump, the abutment shoulder 16 tightly rests against the inlet due to the suction provided by the powered pool pump. The shoulder may be also provided with an O-ring or other sealing gasket 20 to seal the connection to the powered pump inlet to prevent ingestion of externally originating dirt and debris.

An expansible pumping chamber 22 is defined by the telescopicly moveable outer ans inner housings 2, 6 which are closely spaced from each other by an O-ring seal 24 received in a groove provided on a lip 26 at the (upper as shown) end of the inner housing and by a lower seal 28 comprised of an elastomeric sealing band or one or more O-rings located as shown near the lower end of the outer housing 2. A stop ring 30 can be provided on the inner side of the outer housing 2 for engagement with the underside of lip 26 to limit the extent of travel of the housings 2, 6 relative to each other.

One way flow of fluid through the pump is assured by providing a pair of axially aligned flapper valves 40, 50 which are each normally biased to the closed position. The inlet flapper valve 40 is centrally mounted on a ring plate or seat 42 which is press fit or cemented in the outer housing 2 at the end adjacent the hose connector. A beveled inlet opening 44 receives a peripherally beveled valve closure 46, the interengaged bevels ensuring a snug sealing fit and preventing a spring bias 48 from moving the closure 46 beyond the plane defined by the ring plate 42.

Similarly, the outlet flapper valve 50 is seen to comprise a ring plate or seat 52 which is press fit or cemented inside of the inner housing 6 and supported by a radially inwardly extending integral shoulder 54 provided for this purpose. A peripherally beveled outlet opening 56 receives a peripherally beveled closure 58, the interengagement of the beveled surfaces providing a centering seal and preventing movement of the closure 58 past the plane pf the ring plate 52.

Each flapper valve 40, 50 has a spring hinge which may, for example, be a spirally wound spring or a plastic spring having inherent resiliency, either of which are well known. It is contemplated that it may be desirable to use springs which may easily be calibrated or re-calibrated periodically to ensure that the spring bias is not so great as to close the valves against the pressure of water being siphoned through the pump when the pump is not being reciprocated.

As will be evident, the pump is operated to provide axial flow of air and water therethrough by manually grasping the outer housing 2 with one hand and the adaptor end connection 10 with the other hand and reciprocating the pump parts. Of distinct importance is the fact that the unit will not be disconnected from the pool hose prior to connecting the hose to the inlet of the powered pool pump. Instead, the unit is intended be quickly connected to the powered pump inlet after the hose has been evacuated of air and then to remain in place interconnecting the hose and powered pump while the pool is vacuumed after the hand-held pump has performed its function.

Ordinarily, the pump is constructed for unobstructed axial flow all the way therethrough such, that dirt and debris sucked from the bottom of a pool will not clog or impede the pump operation.

Although a pump and adaptor which provides axial flow all the way therethrough is ordinarily preferred, it is occasionally desirable to transversely block the adaptor end with a plate 70 and instead provide a series of one or more radially directed spaced outlet apertures 72 therein for connection with the powered pool pump inlet. A rotatable adaptor cap 74 having a series of radially spaced outlet apertures 76 in the side wall thereof which may be aligned with the apertures 72 in the adaptor by rotating the cap 74 may be provided to prevent ingress of dirt and debris when the unit is not in use.

Persons skilled in the art will readily appreciate that various modifications can be made from the preferred embodiment thus the scope of protection is intended to be defined only by the limitations of the appended claims.

I claim:

1. A hand-held pump and adaptor unit for connecting a swimming pool vacuum hose to a poolside skimmer pump comprising:

a) a first elongated sleeve having an open end and a hose connector collar extending axially therefrom;

b) a second elongated sleeve telescopicly engaged with said first sleeve, said second sleeve having a skimmer pump inlet adaptor at the end thereof remote from said hose connector collar, said adaptor having at least one fluid outlet;

c) sealing means disposed between an outer peripheral wall of one of said sleeves and an inner peripheral wall of the other of said sleeves, said sealing means permitting said sleeves to telescopicly move thereby providing a veriable volume pumping chamber;

d) a first one-way valve permitting fluid flow from said open end into said pumping chamber and preventing reverse flow from said pumping chamber to said open end; and e) a second one way valve in said pumping chamber permitting fluid flow from said pumping chamber to said adaptor outlet and preventing fluid flow from said adaptor outlet into said pumping chamber, said first and said second one-way valves each comprising flappers being biased to the closed position by a spring which also allows the valves to remain in the open position when water is being siphoned through the unit, said hose connector collar, skimmer pump inlet adaptor, and said first and said second one-way valves being sized and aligned on a common axis whereby said unit can pump air or water and can siphon water with ordinary swimming pool debris axially of the unit with minimal restriction.

2. The unit of claim 1, wherein said first and second one-way valves are flapper valves.

3. The unit of claim 2, wherein said first and second valves are respectively mounted on first and second rings each having fluid passageways therethrough which are controlled by said flapper valves, said rings being transversely mounted in said first and second sleeves.

4. The unit of claim 3, wherein said first sleeve is disposed outwardly of said second sleeve.

5. The unit of claim 4, wherein said adaptor includes means for blocking axial flow therethrough.

6. The unit of claim 5, further comprising means for selectively opening or closing said fluid outlet.

7. A fluid pumping device having a longitudinal axis, comprising:

an outer sleeve having an open end and a narrower fluid inlet opening longitudinally spaced from said outer sleeve open end, said outer sleeve open end and said inlet opening being aligned on the longitudinal axis of the device;

an inner sleeve having an open end and a narrower fluid outlet opening longitudinally spaced from said inner sleeve open end, said inner sleeve open end being slidably receivable within said outer sleeve with said inner sleeve open end and said outlet opening being aligned on the longitudinal axis of the device;

sealing means between adjacent surfaces of said inner and outer sleeves permitting said sleeves to reciprocate relative to each other;

a first one-way valve mounted in said outer sleeve adjacent to said fluid inlet opening;

a second one-way valve mounted in said inner sleeve adjacent to said fluid outlet opening;

each said one-way valve having a seat and a unitary valve member pivoted to said seat and moveable from said seat in a direction to permit fluid flow in a direction from said fluid inlet opening to said fluid outlet opening;

said unitary member of each said one-way valve being aligned on the longitudinal axis of said device; said first and said second one-way valves each being biased to the closed position by a spring which also allows the valves to remain in the open position when water is being siphoned through the device, said fluid inlet opening, fluid outlet opening, and said first and said second one-way valves being sized and aligned on a common axis whereby said device can pump or siphon fluids and ordinary pool debris axially of the device without restriction to said axial flow.

* * * * *